US011160336B2

(12) United States Patent
Yurman

(10) Patent No.: US 11,160,336 B2
(45) Date of Patent: Nov. 2, 2021

(54) JEWELRY CABLE

(71) Applicant: David Yurman IP LLC, New York City, NY (US)

(72) Inventor: David M. Yurman, New York, NY (US)

(73) Assignee: David Yurman IP LLC, New York, NY (US)

( * ) Notice: Subject to any disclaimer, the term of this patent is extended or adjusted under 35 U.S.C. 154(b) by 0 days.

(21) Appl. No.: 17/271,983

(22) PCT Filed: Aug. 30, 2019

(86) PCT No.: PCT/US2019/049147
§ 371 (c)(1),
(2) Date: Feb. 26, 2021

(87) PCT Pub. No.: WO2020/047464
PCT Pub. Date: Mar. 5, 2020

(65) Prior Publication Data

US 2021/0244139 A1 Aug. 12, 2021

Related U.S. Application Data

(60) Provisional application No. 62/725,498, filed on Aug. 31, 2018.

(51) Int. Cl.
*A44C 5/10* (2006.01)
*A44C 5/02* (2006.01)
(Continued)

(52) U.S. Cl.
CPC ..... *A44C 5/022* (2013.01); *A44C 5/10* (2013.01); *A44C 5/102* (2013.01); *A44C 5/105* (2013.01); *A44C 27/00* (2013.01); *B21L 11/00* (2013.01)

(58) Field of Classification Search
CPC ..... A44C 5/022; A44C 5/10; A44C 5/102; A44C 5/105; A44C 27/00; B21L 11/00;
(Continued)

(56) References Cited

U.S. PATENT DOCUMENTS 429,978 A * 6/1890 Thomas et al. ..... A44C 11/007 63/4
581,852 A * 5/1897 Dowden ..... F16G 13/10 474/210

(Continued)

FOREIGN PATENT DOCUMENTS

CH 265605 A 12/1949
DE 459114 C 4/1928

OTHER PUBLICATIONS

International Search Report and Written Opinion of PCT Application No. PCT/US2019/49147, dated Nov. 19, 2019, 7 pages.

*Primary Examiner* — Jack W Lavinder
(74) *Attorney, Agent, or Firm* — Gordon & Jacobson, P.C.

(57) ABSTRACT

A flexible jewelry cable includes a plurality of helical links. Each link has a body that extends helically about a central axis of the link. Each link includes a protrusion extending from an inner surface of the body at or near ends of the body. Each protrusion defines a through hole that is coaxially aligned with the body. The body defines a female recess on the inner surface of the body, each recess corresponding to one protrusion. The recesses are at or near the ends of the body. One recess of a first one of the links is configured to receive one protrusion of a second one of the links and align the hole of the received protrusion with the hole of one protrusion of the first link. The cable includes a string extending through the aligned holes of the protrusions of the links.

15 Claims, 5 Drawing Sheets

(51) Int. Cl.
*A44C 27/00* (2006.01)
*B21L 11/00* (2006.01)

(58) Field of Classification Search
CPC ..... B21L 11/005; B21L 11/04; B21L 11/10; F16G 13/00; F16G 13/12; F16G 13/18; F16G 15/00
USPC ..... 63/9, 38, 39; 59/80, 82, 84, 90, 92
See application file for complete search history.

(56) References Cited

U.S. PATENT DOCUMENTS 1,245,965 A * 11/1917 Pratt ..... A44C 11/002 63/38
1,267,544 A * 5/1918 Haubner ..... B60C 11/1612 152/208
1,276,117 A * 8/1918 Riebe ..... F16D 3/848 464/171
1,492,014 A * 4/1924 Benjamin ..... F16G 13/16 59/78.1
1,515,499 A * 11/1924 Lederer ..... A44C 11/002 59/79.2
1,668,359 A * 5/1928 Doty ..... A44C 5/022 59/78
1,702,502 A * 2/1929 Olier, Jr. ..... F21V 21/112 59/78.1
1,894,195 A * 1/1933 Pulver ..... A44C 11/002 63/28
3,135,086 A 6/1964 Shibuya
4,238,935 A * 12/1980 Oudet ..... A44C 11/00 29/433
4,627,231 A 12/1986 Kiuchi
5,074,127 A 12/1991 Yurman
5,197,767 A * 3/1993 Kimura ..... F16G 13/10 138/120
5,660,036 A 8/1997 Rozenwasser
6,108,961 A 8/2000 Milawski et al.
6,481,196 B1 11/2002 Chia et al.
7,841,129 B2 11/2010 Blackshear, Jr.
2006/0265878 A1 11/2006 Zorman
2012/0030914 A1 2/2012 Katz et al.

* cited by examiner

JEWELRY CABLE

CROSS-REFERENCE TO RELATED APPLICATIONS

This application is the national stage of International Patent Application No. PCT/US2019/049147, filed Aug. 30, 2019, which claims priority to U.S. Provisional Patent Application No. 62/725,498, filed Aug. 31, 2018, the entire contents of which are herein incorporated by reference in their entireties.

BACKGROUND

1. Field

The present invention relates to jewelry constructions, such as for bandable jewelry, including bracelets and necklaces. Specifically, the invention relates to jewelry constructions that permit flexibility.

2. State of the Art

Jewelry beads are often strung on a string or wire, leaving the string visible due to large gaps between the beads.

SUMMARY

According to one aspect, further details of which are described below, a flexible cable includes interconnected links, which, when connected together and strung on a string, forms a cable having the appearance of a fully three-dimensional helical surface resembling a rope or cable.

The flexible cable includes a plurality of helical links. Each link has a helical body that extends a single 360 degree revolution about a central axis of the link. Also, each link includes a plurality of male protrusions extending from the body at or near ends of the link. The protrusions extend inwardly toward the central axis. A hole is formed in the center of each protrusion. The hole is coaxial with the body. Also, the body defines a plurality of female recesses that each correspond to one protrusion. The recesses are located at or near the ends of the link, and may be adjacent to each corresponding protrusion. Each recess of a first one of the links is configured to receive a protrusion of a second one of the links and align the hole of the received protrusion with the central axis of the first link and with the center of a hole of a protrusion of the first link that is adjacent to the received protrusion. The system also includes a string or wire extending through the aligned holes of the protrusions of the first and second links.

For each link, a central portion of the body is located between the protrusions and recesses at the ends of the link. The central portion of the body is configured to extend about the central axis in spaced relation thereto. An inner facing (relative to the central axis) side of the central portion defines part of a cavity between the ends of the link. A third one of the links can be nested into the cavity of a first of the links so that the inner facing side of the third link oppositely faces the inner facing side of the first link to thereby enclose the central axis and complete a segment of a fully round cable. The inner facing side of the central portion of each link may define a groove that extending parallel to the central axis. The grooves of each link longitudinally align with one another along the central axis to define a channel or lumen through which the string or cable extends between the protrusions of each link.

The ends of the links may be crescent-shaped. In one embodiment, each link has a first end that has a concave end surface and a second end that has a convex end surface. When a concave end surface of a first link is connected adjacent to a convex end surface of a second link, the assembled links are permitted some degree of relative movement across an interface between the concave and convex end surfaces, while minimizing gapping therebetween, which would reveal the string or wire.

When the links are assembled together and strung on the string, all parting lines between the links will be located on one side (i.e., a back side) of the cable, giving the appearance of an unbroken twisted cable when viewed from the opposite side (i.e., a front display side) of the cable. Gemstones can be set into the outer side of each link very close to the sides of the link and along substantially the entire length of the link. Once assembled into a cable, the unbroken appearance of the cable gives the appearance of gemstones extending about the entire surface of the cable without interruption.

DETAILED DESCRIPTION OF THE PREFERRED EMBODIMENTS

Figure 1:
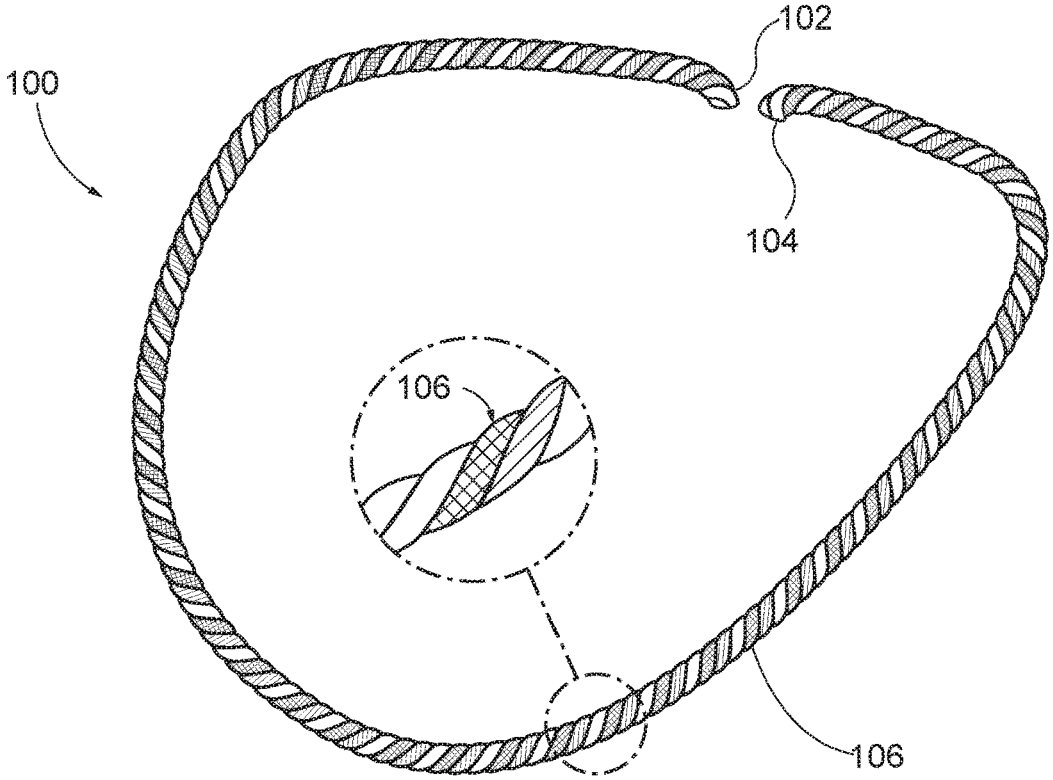
FIG. 1 shows a front view of a flexible cable constructed in accordance with an aspect of the disclosure.
Figure 2:
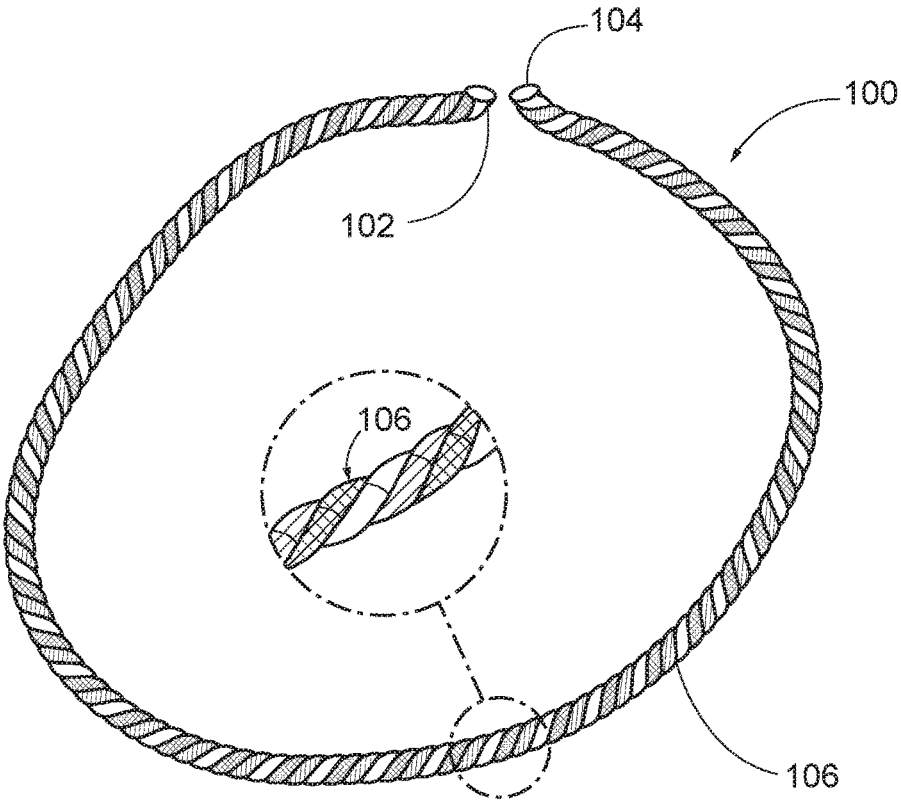
FIG. 2 shows a rear view of the flexible cable of FIG. 1.

FIGS. 1 and 2 show a flexible jewelry cable 100, which can have connectors (not shown) at its ends 102 and 104 for connecting them to form a closed loop, can be worn as a necklace or bracelet, for example. The following description is concerned with the construction of the flexible cable 100, which includes a plurality of helical links 106, which are interconnected together, and to a string 108 (FIGS. 3 and 4) that extends through and between the links 106. Thus, the flexible cable 100 can be considered as having a modular construction, where each link 106 can be considered to be a module having certain common connecting features (described in greater detail below) that allow the links to be assembled together into a unitary cable.

As shown in FIGS. 1 and 2, when the links are coupled together and fully assembled about the string 108, they form the cable 100 which has a three-dimensional helical surface that continues all the way around (360 degrees) the cable 100 so there are no discontinuous flat spots on the sides or back of the cable 100. As shown in the exploded inset in FIG. 1, on the front side of the cable 100, there are no parting lines between the links 106, while in the exploded inset in FIG. 2, the only parting lines 110 evident are located on the back side of the cable 100. In view of this construction, a visual appearance of a continuous cable is presented when the cable is looped and worn with the front or display side facing out.

Figure 3A:
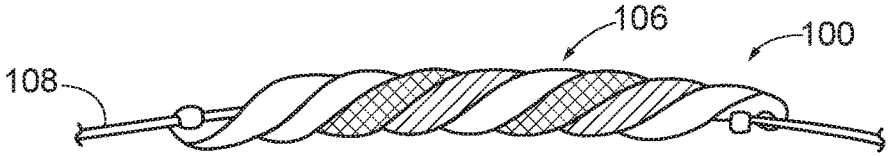
FIG. 3A shows the front side of a portion of the cable of FIG. 1 when flexed in a first direction along the length of the portion.
Figure 3B:
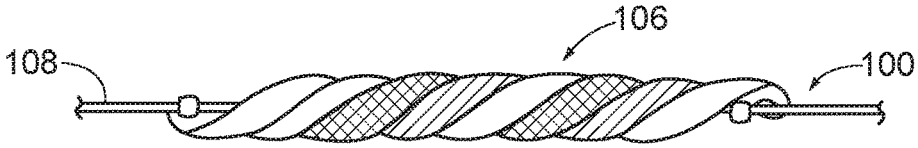
FIG. 3B shows the front side of the portion of the cable of FIG. 3A when in an unflexed condition.
Figure 3C:
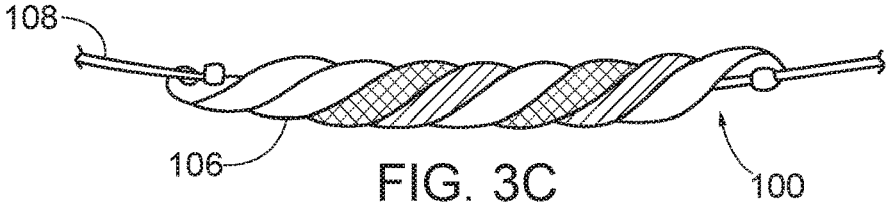
FIG. 3C shows the front side of the portion of the cable of FIG. 3A when flexed in a second direction opposite to that in FIG. 3A.
Figure 4A:
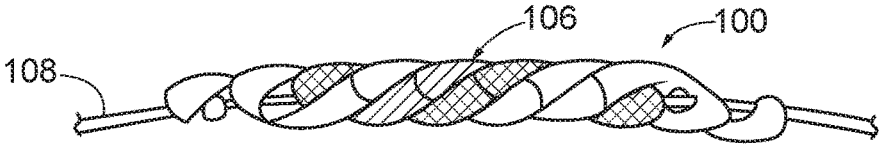
FIG. 4A shows the rear side of a portion of the cable of FIG. 1 when flexed along the length of the portion.
Figure 4B:
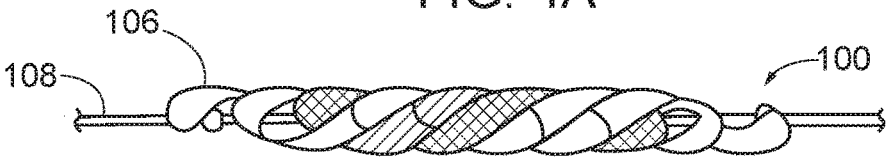
FIG. 4B shows the rear side of the portion of the cable of FIG. 4A when in an unflexed condition.
Figure 4C:
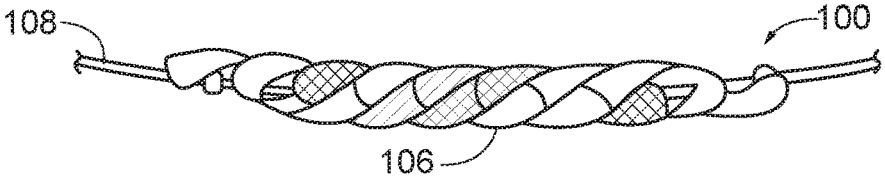
FIG. 4C shows the rear side of the portion of the cable of FIG. 4A when flexed in a second direction opposite to that in FIG. 4A.

The specific modular construction of the cable 100 is useful for permitting the cable 100 to flex a certain amount while simultaneously concealing the string or string 108 that extends through the links 106. FIGS. 3 and 4 show, respectively, front and rear views of a portion of the cable 100 of FIG. 1 when the cable is flexed. FIGS. 3A to 4C show that there is minimal gapping between the adjacent links 106 when the cable is flexed. This minimal gapping aids in concealing the string 108 from view.

Figure 5:
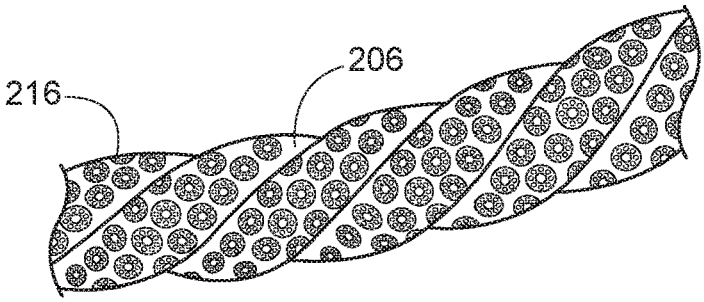
FIG. 5 shows a portion of an alternate embodiment of the links of the cable of FIG. 1 with gemstones set into links.

In addition to the foregoing features, the near-continuous surface of the cable 100 provides a large surface area that allows for gemstones to be inset or otherwise located on all sides of the cable for a continuous appearance as well. For example, FIG. 5 shows an alternate embodiment of links 206, which include gemstones 216 set into the outer surface of the links 206. In links 206, three rows of gemstones 216 arc shown set into each link 206. Of course, the number of gemstones and their arrangement on the links 206 can vary from that shown in FIG. 5, and such variation may be based on the relative size of the surface area of the outside of the link 206 and the size of the gemstones 216.

Figure 6A:
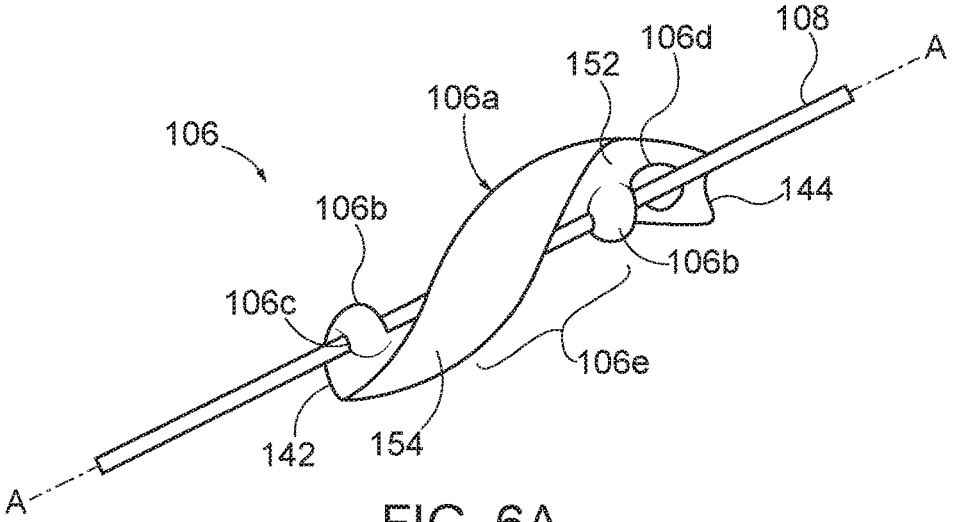
FIGS. 6A and 6B show one of the links of the cable of FIG. 1 viewed respectively from a front (top) and rear (bottom) side.
Figure 6B:
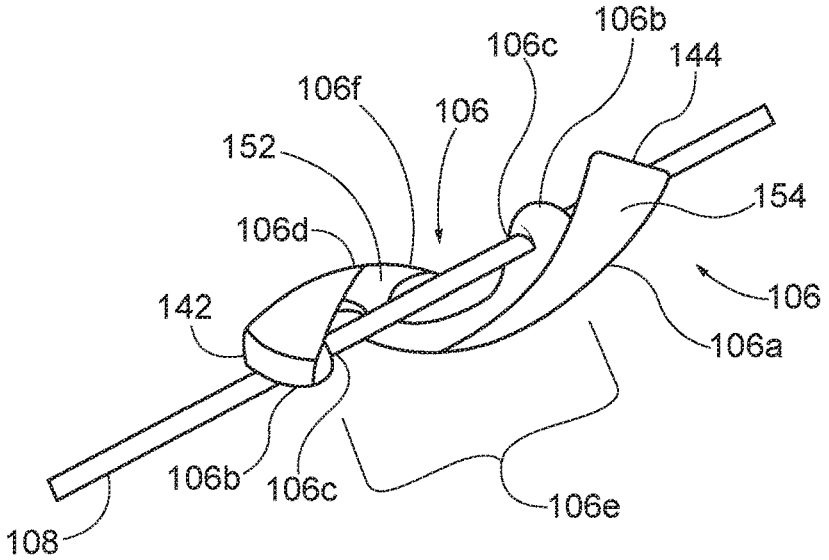

FIGS. 6A and 6B show a representative one of the plurality of links 106 of the cable 100 connected to a string 108. As used herein, a string 108 may be any single or multi-filamentary material made, leather, fabric, or polymer that is capable of bending and flexing into a loop without breaking. If made of metal, the metal may be made of precious metal or non-precious metal. A string may include a wire, cable, or a chain. The links 106 may be made of precious metals, such as gold, silver, and platinum, or non-precious metals. Also, at least a portion of the links, such as their outer surface, may bear indicia (such as text or logos) and/or may be colorized, such as by being plated, painted, or enameled in various colors. Thus, due to the modular construction of the cable 100 various combinations of links 106 of different metals or colors can be made to form various cable designs.

Each link 106 has a helical body 106*a* that extends a single 360 degree revolution about a central axis A-A of the link 106. The body 106*a* extends from a first end 142 to a second end 144. The body has an inner surface 152 facing the central axis A-A. and an outer surface 154 facing outward with respect to the central axis A-A. The link 106 includes a plurality of male protrusions 106*b* at or near ends 142 and 144 of the link. The protrusions 106*b* extend radially toward the central axis from the inner surface 152 of the body 106*a*. Each protrusion 106*b* defines a through hole 106*c* that is coaxially aligned with the body 106*a* and which is configured to receive the string 108. The diameter of the hole 106*c* may be slightly larger than the diameter of the string 108 to permit relative movement between the protrusion 106*b* and the string 108.

Also, the body 106*a* defines a plurality of female recesses 106*d* on the inner surface of the body 106*a*, each of which corresponds to one male protrusion 106*b* of the link 106. The recesses 106*d* are located at or near the ends 142 and 144 of the link 106, and the recesses 106*d* may be adjacent to their corresponding protrusions 106*b*.

Thus, pairs of recesses 106*d* and male protrusions 106*b* may be located at the ends 142 and 144 of the body 106, and such pairs are spaced from each other by a central portion 106*e* of the body. On the interior surface of the central portion 106*e* there is formed a depression or groove 102*f* that extends longitudinally along axis A-A and which provides clearance for the string 108 to pass between the protrusions 106*b*.

Figure 7:
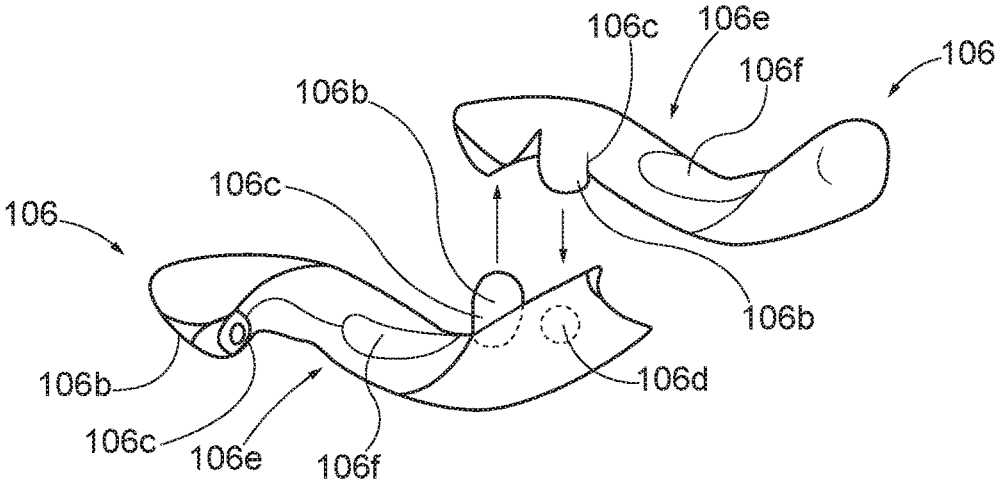
FIG. 7 shows details of mating features of two of the links shown in FIGS. 6A and 6B.

As shown in FIG. 7, each recess 106*d* of a first one of the links 106 is configured to receive a protrusion 106*b* of a second one of the links 106 to align the hole 106*c* of the received protrusion 106*b* with the central axis of the first link 106 and with the center of a hole 106*c* of a protrusion 106*b* of the first link that is adjacent to the received protrusion 106*b*.

Figure 8:
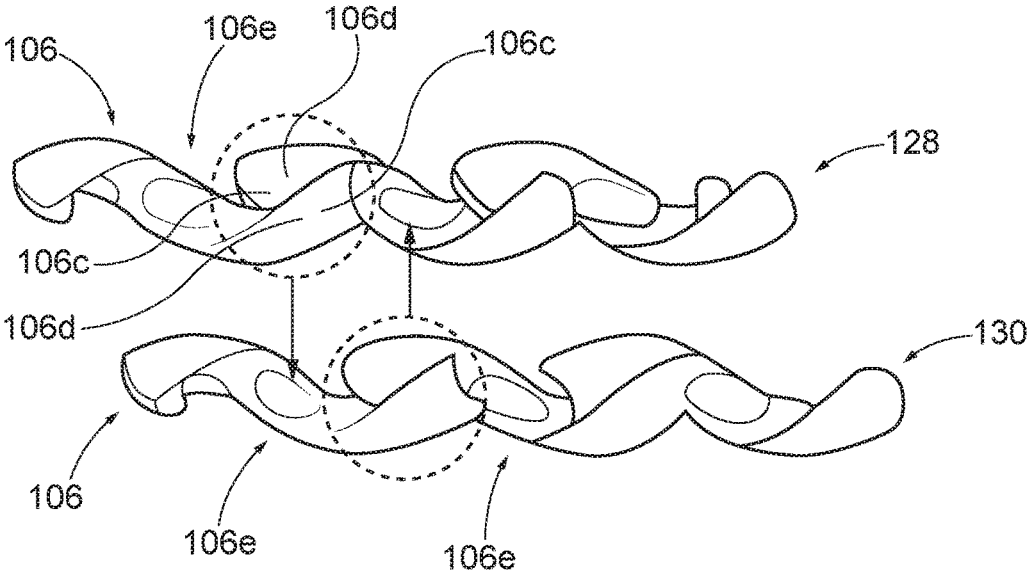
FIG. 8 shows two strands of connected links being combined together to form the cable.

FIG. 8 shows two strands 128 and 130 of coupled links 106, with each strand having aligned protrusions 106*b*. When the links 106 are coupled together, and the protrusions are aligned, the string 108 may be inserted through the holes of the aligned protrusions 106*b* to bind the links 106 together and provide them with support.

Turning now momentarily back to FIG. 6A, the central portion 106*e* of the body 106*a* of the link 106 (e.g., first link) is configured to extend about the central axis A-A in spaced relation thereto. As shown in FIG. 6B, when the first link 106 is connected to the string 108, the inner surface of the central portion 106*e* is visible and exposed, along with the string 108 extending between the protrusions 106*b*. Indeed, in FIG. 6B a cavity 160 is defined between the inner surface of the central portion 106*e* and the protrusions 106*b*. To cover the cavity 160, a second link 106 can be nested over the exposed central portion 106*e*, such that the cavities 160 of both links oppositely face one another across the string 108, thereby surrounding and enclosing the cavities 160 of both links. When the second link 106 is so placed, its protrusions 106*b* will align with the protrusions 106*b* of the first link.

Figure 9:
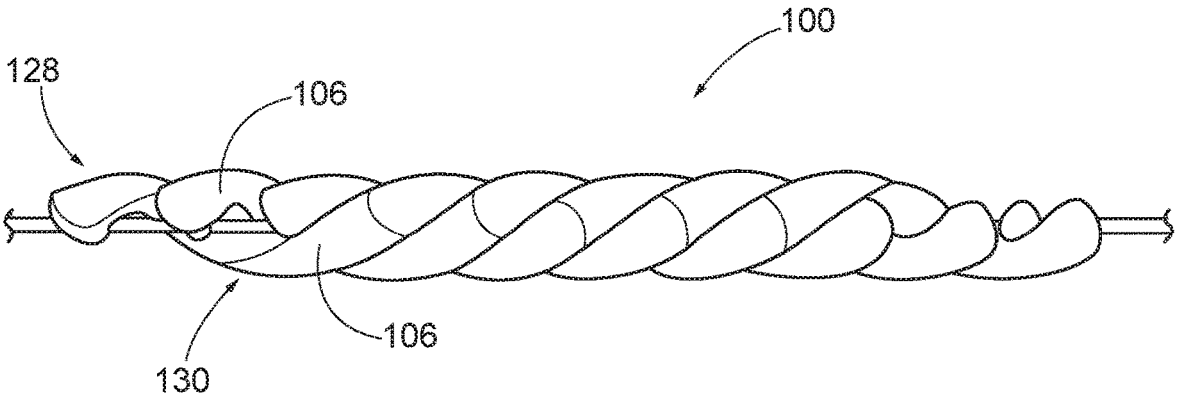
FIG. 9 shows a portion of the cable of FIG. 1 after the two strands of FIG. 8 are intertwined together.

An example of such nesting is shown in FIG. 8, where the upper strand 128 of connected links 106 and the lower strand 130 of connected links 106 are shown with arrows indicating movement of portions of the strands 128 and 130 to relatively position the central portions 106*e* of respective links 106 to cover the exposed spaces on the inside of the central portions 106*e* of the links 106. It will be appreciated that the full cable 100 can be considered as being formed of the two strands 128 and 130, which become coiled around one another when the links 106 of the strands 128 and 130 nest into the spaces described above. When the links 106 of both strands 128 and 130 are nested and intertwined, all of the protrusions 106*b* of the links 106 of both strands 128 and 130 align with one another so that the string 108 can be introduced through all of the holes 106*c* in the protrusions 106*b*, as shown in FIG. 9, to thereby string all of the links together forming the cable 100.

Figure 10:
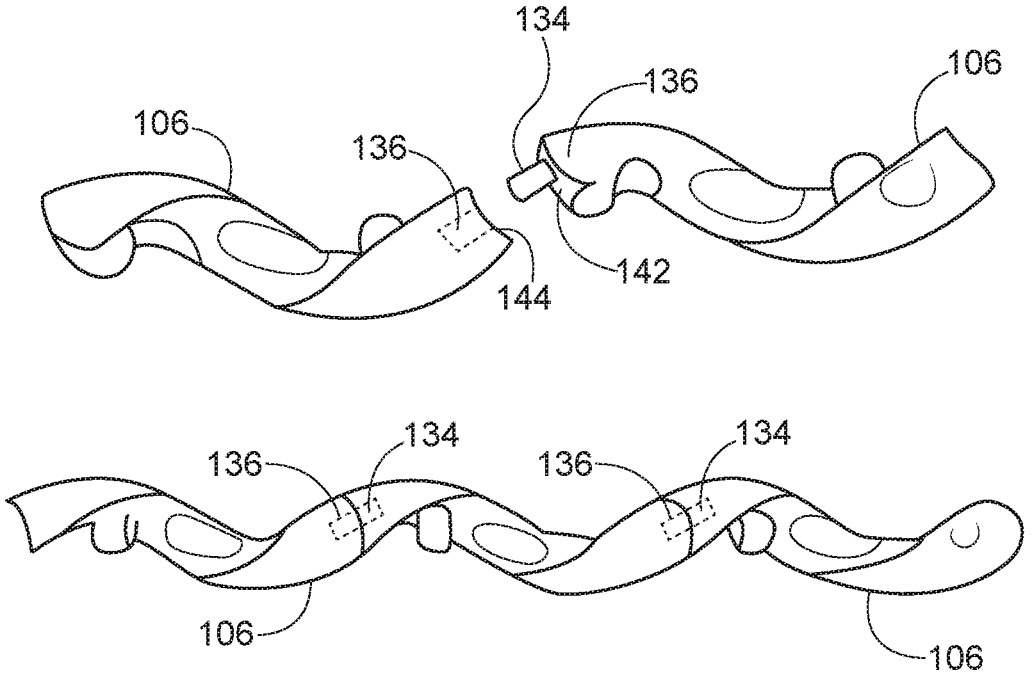
FIG. 10 shows the placement of a pin or coupling element connecting ends of a pair of links together.

When the links 106 of the strands 128 and 130 nest together, the ends 142 and 144 of the bodies 106*a* of the links 106 of strand 128 abut the ends 142 and 144 of the bodies 106*a* of the links 106 of strand 130. The body 106*a* of each link 106 may define a longitudinally extending pin hole 136 at each end 142 and 144 of the body 106*a*. Each pin hole 136 is configured to receive a portion of a pin or peg 134. The pin or peg 134 is configured to be inserted through pin holes 136 to connect ends 142 and 144 together when they abut one another, which further connects the links 106 of the two strands 128 and 130 together, as shown in FIG. 10. As shown in FIG. 10, the hole 136 and pin or peg 134 in each end 142 and 144 are aligned with one another when the ends 142 and 144 of the links abut. The pins or pegs 134 can increase stability of the cable 100 and can further reduce gapping between the links 106.

Figure 11:
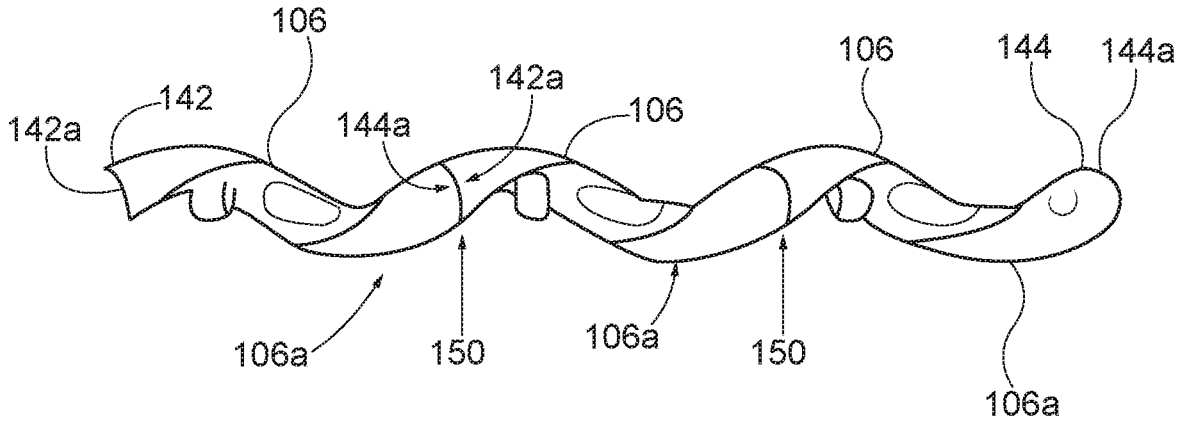
FIG. 11 shows further details of mating surfaces between ends of links.

As shown in greater detail in FIG. 11, the ends 142 and 144 of the body 106*a* of link 106 may have, respectively, concave and convex (i.e., crescent-shaped) end surfaces 142*a* and 144*a*. When a first link 106 having a first end 142 with a concave end surface 142*a* is connected adjacent to a second link 106 having a second end 144 with a convex end surface 144*a*, an interface or joint 150 formed therebetween permits some degree of relative movement and flexure between the two links 106, while minimizing gapping therebetween. Indeed, the concave and convex surfaces provide complementary mating surfaces that allow some amount of pivoting and sliding across the interface 150 between to provide flexure or relative movement between the connected links 106.

There have been described and illustrated herein several embodiments of a flexible cable and a method of making the cable. While particular embodiments of the invention have been described, it is not intended that the invention be limited thereto, as it is intended that the invention be as broad in scope as the art will allow and that the specification be mad likewise. Thus, while particular materials have been disclosed for the construction of the cable, it will be appreciated that other suitable materials may be used as well. In addition, while particular connection types between the parts of the cable have been disclosed, it will be understood that other suitable connection types can be used. For example, and not by way of limitation, the links may employ a snap-fit ball and socket connection between the links. It will therefore be appreciated by those skilled in the art that yet other modifications could be made to the provided invention without deviating from its spirit and scope as claimed.

What is claimed is:

1. A flexible cable comprising:

a plurality of helical links, each link coupled to one another, and each link having:

a body that extends helically about a central axis of the link, the body having an inner surface and an outer surface, a male protrusion extending from the inner surface of the body at both ends of the body, wherein each protrusion defines a hole formed through the protrusion, each hole being coaxial with the body, wherein the body defines a female recess on the inner surface of the body corresponding to each protrusion, the recesses located at both ends of the body, wherein the body has a central portion located on the inner surface between the pairs of protrusions and recesses, the central portion extending about the central axis and being spaced therefrom and having a cavity defined between the pairs of protrusions and recesses; and a string extending through the holes formed through each protrusion and coupling the plurality of links.

2. The cable according to claim 1, wherein:

the plurality of links includes at least a first link, a second link, and a third link, and wherein one of the recesses of the first link is configured to receive one of the protrusions of the second link and thereby align the hole of the received protrusion of the second link with the hole of one of the protrusions of the first link.

3. The cable according to claim 2, wherein:

the cavity of the third link is configured to oppositely face and align with either of the cavity of the first link or the cavity of the second link to thereby surround and enclose the central axis between the third link and either of the first link or the second link and to align the protrusions of the third link with the protrusions of either of the first link or the second link along the central axis, wherein the string or wire extends through the holes of the aligned protrusions.

4. The cable according to claim 1, wherein the central portion defines a groove that extends parallel to the central axis.

5. The cable according to claim 2, wherein the grooves of coupled links are configured to align along the central axis and define a channel or lumen aligned with the protrusions of respective links through which the string or cable extends.

6. The cable according to claim 1, wherein the body has a first end having a concave end surface and a second end having a convex end surface which is a complementary mating surface to the concave end surface.

7. The cable according to claim 6, wherein each link defines a longitudinally extending pin hole formed in the first and second ends of the body, wherein the cable further includes:

a pin received in the pin holes to connect pairs of the links together.

8. The cable according to claim 7, wherein the pin hole formed in the first end of the body of the first link is configured to align with the pin hole formed in the second end of the body of the second link, and wherein one pin extends through both the pin hole formed in the first end of the body of the first link and the pin hole formed in the second end of the body of the second link.

9. A flexible cable comprising:

a plurality of interconnected helical links defining an inner lumen along an axis, wherein the interconnected links form a fully three-dimensional helical outer surface;

a string extending through the inner lumen of interconnected helical links, thereby stringing the plurality of interconnected helical links forming the cable together.

10. The cable according to claim 9, wherein:

each link had at least one protrusion and at least one recess, wherein the protrusion of each link is received in a recess of another one of the links.

11. The cable according to claim 10, wherein:

each protrusion defines a through hole coaxial with the lumen.

12. The cable according to claim 11, wherein:

the string extends through the through holes of each protrusion.

13. The cable according to claim 9, wherein:

each link has a body that extends helically about the axis, the body having an inner surface facing the string and defining the lumen.

14. The cable according to claim 13, wherein:

each link extends longitudinally along the axis between two ends and has a male protrusion extending from the inner surface of the body at both ends of the body, wherein each protrusion defines a hole formed through the protrusion, each hole being coaxial with the axis and through which the string extends.

15. The cable according to claim 14, wherein:

the body defines a female recess on the inner surface of the body corresponding to each protrusion, the recesses located at both ends of the body, and wherein the body has a central portion located on the inner surface between the pairs of protrusions and recesses, the central portion extending about the axis and being spaced therefrom and having a cavity defined between the pairs of protrusions and recesses.

* * * * *